US008973801B2

(12) United States Patent
Klein et al.

(10) Patent No.: US 8,973,801 B2
(45) Date of Patent: Mar. 10, 2015

(54) ROLL OR BUFFER STORAGE FOR A FLAT WEB MATERIAL

(75) Inventors: Peter Klein, Kleve (DE); Dietmar Klüsener, Kleve (DE)

(73) Assignee: KHS GmbH, Dortmund (DE)

( * ) Notice: Subject to any disclaimer, the term of this patent is extended or adjusted under 35 U.S.C. 154(b) by 452 days.

(21) Appl. No.: 12/993,340

(22) PCT Filed: May 12, 2009

(86) PCT No.: PCT/EP2009/003345

§ 371 (c)(1),
(2), (4) Date: Nov. 18, 2010

(87) PCT Pub. No.: WO2009/141072

PCT Pub. Date: Nov. 26, 2009

(65) Prior Publication Data

US 2011/0062206 A1 Mar. 17, 2011

(30) Foreign Application Priority Data

May 20, 2008 (DE) ..... 10 2008 024 367

(51) Int. Cl.

| | |
|---|---|
| ***B65H 43/00*** | (2006.01) |
| ***B65H 20/32*** | (2006.01) |
| ***B65H 20/34*** | (2006.01) |
| ***B65H 26/02*** | (2006.01) |

(52) U.S. Cl.

CPC ..... *B65H 20/34* (2013.01); *B65H 26/02* (2013.01); *B65H 2301/522* (2013.01)

USPC ..... 226/11; 226/118.2; 242/417.1; 242/552

(58) Field of Classification Search

USPC ..... 226/1, 4, 11, 90, 113, 118.2, 189; 242/417.1, 552

See application file for complete search history.

(56) References Cited

U.S. PATENT DOCUMENTS

| | | | | | |
|---|---|---|---|---|---|
| 3,006,571 | A | * | 10/1961 | Vischulis | 242/421.6 |
| 3,025,017 | A | * | 3/1962 | Wahlstrom | 242/417.2 |
| 3,414,208 | A | * | 12/1968 | Butler et al. | 242/421.6 |
| 3,533,543 | A | * | 10/1970 | Wenger | 226/44 |
| 3,722,769 | A | * | 3/1973 | Aplet et al. | 226/25 |
| 3,743,153 | A | * | 7/1973 | Moss | 226/91 |

(Continued)

FOREIGN PATENT DOCUMENTS

| | | |
|---|---|---|
| DE | 3731350 | 4/1989 |
| DE | 3743763 | 6/1989 |
| EP | 0307558 | 3/1989 |

*Primary Examiner* — William E Dondero

(74) *Attorney, Agent, or Firm* — Occhiuti & Rohlicek LLP

(57) ABSTRACT

A buffer store for a flat web material includes two roller registers having freely rotatable rollers movable relative to one another in a direction radial to a roller axis, thereby forming loops of the web material between the rollers, a piston-cylinder arrangement having a chamber containing a compressible medium and acting as a spring between the registers to generate web tension in the material, and a control-valve arrangement that switches between a first condition, for normal operation, and a second condition, for operation during a fault. In the first condition, the control-valve arrangement connects the cylinder chamber of the piston-cylinder arrangement to a device for providing a constant operating pressure. In the second condition, the control-valve arrangement closes the cylinder chamber of the piston-cylinder arrangement and connects it to a relief valve that relieves pressure therein to a residual pressure significantly smaller than the operating pressure.

11 Claims, 2 Drawing Sheets

(56) References Cited

U.S. PATENT DOCUMENTS

| | | | | | |
|---|---|---|---|---|---|
| 3,813,052 | A | * | 5/1974 | Swann et al. | 242/420.3 |
| 3,891,158 | A | * | 6/1975 | Shearon et al. | 242/554.4 |
| 3,974,948 | A | * | 8/1976 | Kroppenstedt | 226/38 |
| 4,325,519 | A | * | 4/1982 | McLean | 242/417.2 |
| 4,603,800 | A | * | 8/1986 | Focke et al. | 242/417.2 |
| 4,798,353 | A | * | 1/1989 | Peugh | 242/417.2 |
| 4,886,199 | A | | 12/1989 | Noe et al. | |
| 5,024,156 | A | * | 6/1991 | Hank et al. | 101/216 |
| 5,186,409 | A | | 2/1993 | Kansaku | |
| 5,791,541 | A | * | 8/1998 | Jitsuishi et al. | 226/40 |
| 5,826,774 | A | * | 10/1998 | Dell'Aglio et al. | 226/44 |
| 6,073,876 | A | * | 6/2000 | Suzuki et al. | 242/421.6 |
| 6,216,934 | B1 | | 4/2001 | Searles | |

* cited by examiner

ROLL OR BUFFER STORAGE FOR A FLAT WEB MATERIAL

CROSS-REFERENCE TO RELATED APPLICATIONS

This application is the National Stage of International Application No. PCT/EP2009/003345, filed on May 12, 2009, which claims the benefit of German Application Serial No. 10 2008 024 367, filed on May 20, 2008, the contents of both of the foregoing applications are hereby incorporated by reference in their entirety.

FIELD OF DISCLOSURE

The invention relates to a roll or buffer store.

BACKGROUND

Roll or buffer stores for flat web materials, particularly for web-shaped packaging materials or films, are known and are used in systems for processing the flat material, for example in packaging systems, to maintain a predetermined web tension by intermediate storage of a variable length of the flat material. Buffer stores of this type comprise at least two roller registers. These roller registers have parallel rollers that are spaced apart from one another. These rollers are mounted so as to freely rotate in the roller registers. As it is guided over these rollers, the flat web forms a plurality of loops.

The roller registers are arranged to be movable relative to one another. In some cases, one roller register is fixed and the other roller register is movable, for example, by being pivotable in an axis direction radially to the rotation axis of the rollers.

A spring causes tension in the flat material between the roller registers. In known buffer stores, this spring is formed by at least one piston-cylinder arrangement, such as a pneumatic cylinder. This cylinder has at least one cylinder chamber to which the operating pressure of a compressible fluid can be applied. A suitable compressible fluid is air. The piston-cylinder arrangement thus acts as a gas spring or as a compressed-air spring.

A disadvantage of these known buffer stores is that, in the event of a fault, and particularly if the flat web material tears, the full working pressure still acts in the cylinder chamber. As a result of this tear, the now-torn flat material can no longer hold the movable roller register back. As a result, the roller register suddenly moves to the end position of its movement stroke or pivot stroke. This sudden and violent movement of a heavy object causes a significant risk of injury to operating personnel.

SUMMARY

It is an object of the invention to provide a roll or buffer store that avoids this disadvantage and that has significantly better operational safety.

The buffer store according to the invention operates in a first condition and a second condition of a first control valve arrangement. The first condition is used for normal operation. The second condition is used during a fault.

In the first condition, the cylinder chamber of a piston-cylinder arrangement connects to a device for providing the operating pressure. In case of a machine standstill and/or a fault, the first control valve arrangement switches into the second condition, in which it not only interrupts the connection of the cylinder chamber to the device for providing the operating pressure, but also traps the volume of fluid or pressure medium present in the cylinder chamber.

At the same time, the pressure in the cylinder chamber to a residual pressure drops significantly below the operating pressure. This residual pressure is, for example, in the range of only 30% to 40% of the operating pressure. It is essential that the residual pressure be adjusted to depend on the mass of the pivot arm of the roll or buffer store.

Reduction of the pressure to the residual pressure is carried out via a relief valve that is also preferably switched with the first control valve arrangement. The relief valve is configured so that it opens at a pressure above the residual pressure and brings about pressure relief, for example by venting to the atmosphere, and blocks at a pressure less than or equal to the predetermined residual pressure.

In the event of a machine standstill and/or a fault, the tension in the flat material is very low. But it is still sufficient for maintaining the proper running of the flat material through the buffer store with the residual pressure. By trapping the pressure medium in the cylinder chamber and by using the relief valve which is, for example, a safety valve adjusted to the residual pressure, it is also achieved that, in the event of tearing of the flat web material and the associated removal of the load on the movable roller register, although a slight movement of the roller register takes place due to the piston-cylinder arrangement acting as a gas spring, the distance of this movement and the force exerted by the piston-cylinder arrangement are both extremely small, particularly due to the expansion of the pressure medium trapped in the cylinder chamber and the associated further reduction of the pressure below the residual pressure. In one aspect, the invention features a buffer store for a flat web material. The buffer store comprises at least two roller registers that each have a plurality of freely rotatable rollers and that are movable relative to one another at least in an axis direction radially to the axis of the rollers specifically forming variable partial lengths or loops of the flat web material between the rollers of the roller registers, and a piston-cylinder arrangement, to the cylinder chamber of which a compressible pressure medium, for example, compressed air can be applied, the piston-cylinder arrangement acting in the manner of a compression spring or gas spring between the at least two roller registers in order to generate a web tension in the flat material guided through the buffer store, and a control device for applying a constant or substantially constant operating pressure of the pressure medium to the piston-cylinder arrangement, characterized in that the control device has a first control valve arrangement which, in a first condition during normal operation, connects the cylinder chamber of the piston-cylinder arrangement to a device for providing the constant or substantially constant operating pressure and, in the event of a machine standstill and/or a fault, switched into a second condition, closes the cylinder chamber of the piston-cylinder arrangement and connects the cylinder chamber to a relief valve which brings about relief of the pressure in the cylinder chamber to a residual pressure which is significantly smaller than the operating pressure.

Embodiments of the buffer store include those in which the relief valve opens at a pressure above the residual pressure and blocks at a pressure that is less than or equal to the residual pressure. Examples of such a valve include a safety valve.

In some embodiments, the residual pressure is set to approximately 30% to 40% of the operating pressure. In other embodiments, the residual pressure is adjusted in a manner that depends on the mass of the pivot frame. Also included are embodiments in which the residual pressure is adjusted to approximately 1 bar.

In some embodiments, a throttle with a non-return valve is arranged parallel to the connection between the first control valve and a piston-cylinder arrangement. The non-return valve opens for flow out of the cylinder chamber of the piston-cylinder arrangement and blocks flow in the opposing direction. Preferably, this throttle is adjustable.

In other embodiments, the first control valve arrangement is controllable by the pressure of the pressure medium such that, in the absence of pressure from the pressure medium, the control valve arrangement assumes the second condition thereof.

In yet other embodiments, the device for providing the operating pressure is a pressure controller.

Some embodiments include a second control valve arrangement that can be switched between two conditions. A first condition connects the cylinder chamber of the piston-cylinder arrangement to the device for providing the pressure medium at operating pressure. The second condition vents the cylinder chamber to the atmosphere.

In other embodiments, the first and/or second control valve arrangements are formed from at least one control valve.

In yet other embodiments, one roller register is fixed and one roller register is movable.

Also included are embodiments in which a movable roller register is provided on a pivot frame and a piston-cylinder arrangement acts between the pivot frame or an arm of the pivot frame and a machine frame element of the buffer store.

In one aspect, the invention features an apparatus that has a buffer store for guiding flat web material. The buffer store has first and second roller registers, a pivot arm, first and second sets of rollers on the respective first and second roller registers, a piston/cylinder arrangement, a control device, and a relief valve. The rollers are freely rotatable. The first set of rollers includes a first roller that rotates about a roller axis that defines a radial direction that is perpendicular to it. The first roller register is moveable relative to the second roller register along the radial direction. Both roller registers cooperate in forming loops of the flat web material between rollers of the first and second sets of rollers. These loops have lengths that vary in response to movement of either roller register. The pivot arm supports either roller register. In operation, a cylinder chamber within the piston-cylinder arrangement contains a compressible pressure medium. As a result, the piston-cylinder chamber operates as a spring between the roller registers. As the flat web material is guided through the buffer store, the piston-cylinder chamber causes web tension in it. The control device includes a first control valve arrangement that switches between operating in first and second conditions. The control device causes the first control valve arrangement to switch into operating in the first condition during normal operation of the buffer store and to switch into operating in the second condition during abnormal operation. Abnormal operation means either operation during a machine standstill or operation during a machine fault. When operating in the first condition, the first control valve arrangement connects the cylinder chamber to a pressure source for providing a normal operating pressure. When operating in the second condition, the first control valve arrangement traps pressure medium in the cylinder chamber, thereby causing the cylinder chamber to assume a selected abnormal operating pressure. The selected abnormal operating pressure, which is above atmospheric pressure and below the normal operating pressure, is a function of the pivot arm's mass. To transition into the second condition, the first control valve arrangement connects the cylinder chamber to the relief valve, thereby causing pressure in the cylinder chamber to decrease from the normal operating pressure to the abnormal operating pressure. The first control valve arrangement is also configured such that when pressure from the pressure medium at the first control valve arrangement falls below a threshold, the first control valve arrangement assumes the second condition thereof in response.

In some embodiments, the relief valve comprises a safety valve that opens at a pressure above the abnormal operating pressure and blocks at a pressure that is equal to or smaller than the residual pressure.

In other embodiments, the abnormal operating pressure is set to approximately 30% to 40% of the normal operating pressure.

Yet other embodiments of the buffer store include a pressure controller for providing the operating pressure.

Also among the embodiments are those that have a second control valve arrangement. This second control valve arrangement is controllable between a first condition and a second condition. When the second control valve arrangement is in the first condition and the first control valve arrangement is in the first condition thereof, the second control valve arrangement connects the cylinder chamber of the piston-cylinder arrangement to the pressure source for providing a normal operating pressure. When in its second condition, the second control valve arrangement vents the cylinder chamber into the atmosphere.

In some embodiments, at least one of the first and second roller registers is a fixed roller register and at least one of the first and second roller registers is a movable roller register.

Other embodiments include a machine frame. In these embodiments, one of the roller registers comprises a movable roller provided on the pivot arm, and the piston-cylinder arrangement acts between the pivot arm and the machine frame.

Among the embodiments are those in which the piston-cylinder arrangement is configured to act as a gas spring and those in which the piston-cylinder arrangement is configured to act as a compression spring.

Yet other embodiments include a throttle with a non-return valve arranged parallel to the throttle. The throttle provides a connection between the first control valve arrangement and the piston-cylinder arrangement. The non-return valve is configured to open for flow out of the cylinder chamber and to block flow in a direction that opposes the flow out of the cylinder chamber. In some of these embodiments, the throttle comprises an adjustable throttle.

Developments, advantages and possible applications of the invention are also disclosed in the following description of exemplary embodiments and in the drawings. All the features described and/or illustrated are fundamentally the subject matter of the invention either per se or in any combination, regardless of their grouping together in the claims or their back references. The content of the claims is also made a part of the description.

BRIEF DESCRIPTION OF THE DRAWINGS

The invention will now be described in greater detail by reference to an exemplary embodiment illustrated by the drawings, in which.

DETAILED DESCRIPTION

Figure 1:
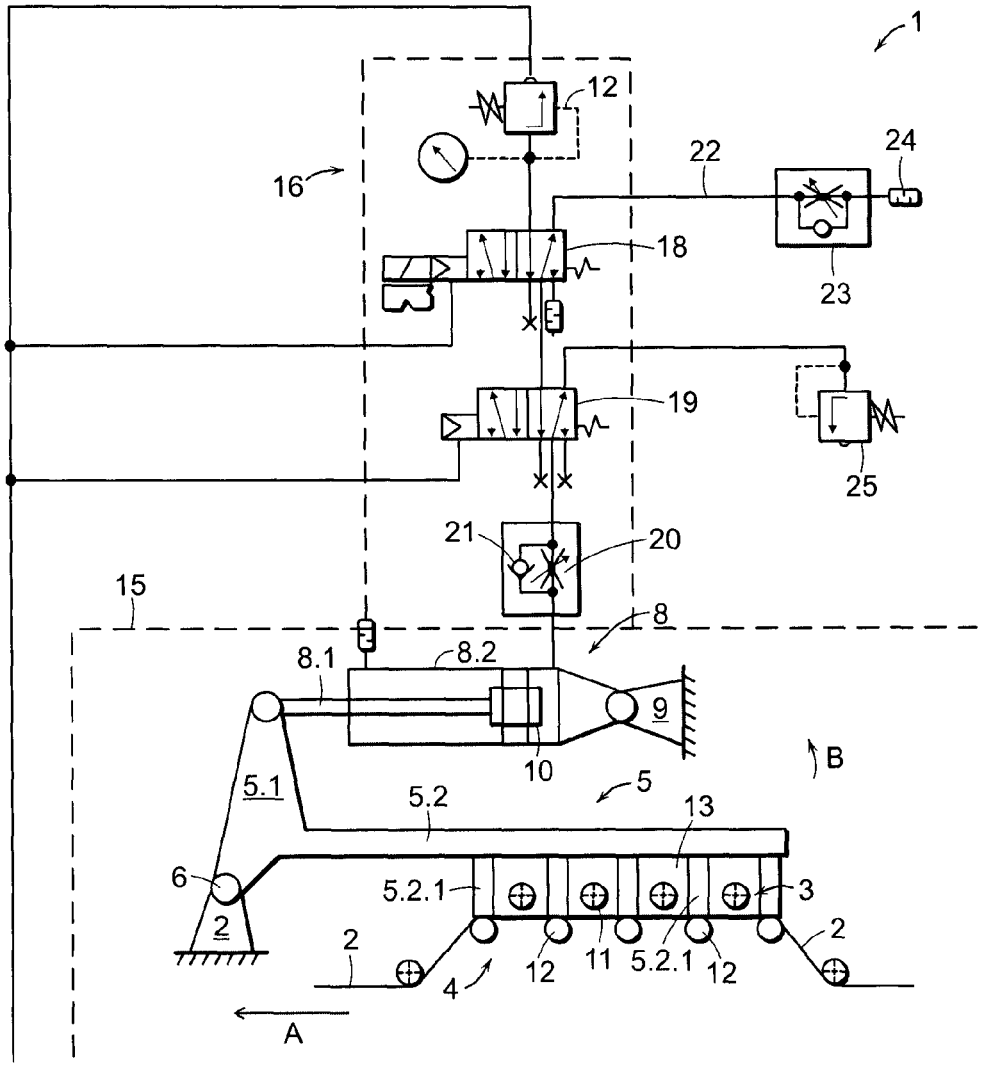
FIG. 1 shows, in a simplified illustration, a roll or buffer store according to the invention for a flat web material, having associated pneumatic and control systems.
Figure 2:
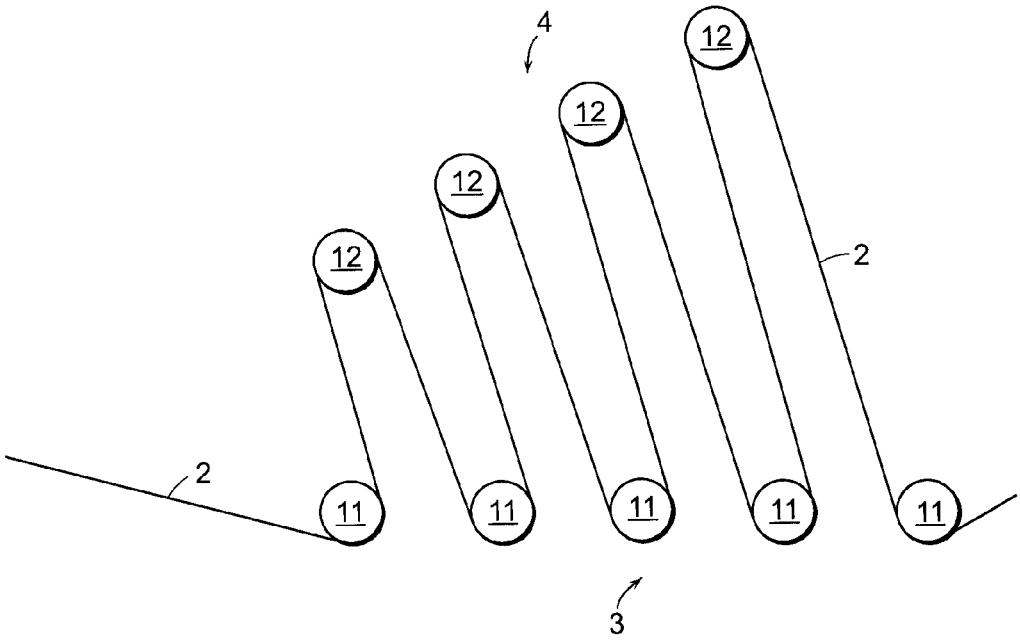
FIG. 2 shows, in a simplified illustration, the two roller registers of the buffer store of FIG. 1 together with the flat material tensioned between these roller registers.

The figures show a roll or buffer store 1 for intermediate storage of a length of flat web material 2 guided through the buffer store 1. An example of a flat web material is a packaging material or a packaging film.

The buffer store 1 is a component part of a system for packaging objects and is arranged upstream in the system in the advance or conveying direction A of the flat material 2 of a packaging machine.

The buffer store 1 comprises a fixed roller register 3 and a movable roller register 4. The movable roller register 4 is movable relative to the fixed roller register 3.

In the embodiment shown, the movable roller register 4 is provided on a pivot frame 5 that is articulated via a joint 6 to a frame element 7 of the buffer store 1, specifically pivotable about an axis parallel to the surfaces of the flat material 2 that is guided through the buffer store 1 and perpendicular to the longitudinal extent of the material or perpendicular to the advance and conveying direction A.

A pneumatic cylinder 8 provides tension in the flat material 2 between the fixed and movable roller registers 3, 4. It does so by pivoting the pivot frame 5 about the axis of the joint 6 (arrow B). The pneumatic cylinder 8 acts between an arm 5.1 of the pivot frame 5 oriented radially to the axis of the joint 6 and a frame element 9 of the buffer store 1. For this purpose, the pneumatic cylinder 8 is articulated with the piston rod 8.1 thereof relative to the arm 5.1 and the cylinder 8.2 thereof is articulated relative to the frame element 9.

The pneumatic cylinder 8 applies pressure provided by a compressible fluid or pressure medium to its cylinder chamber 10. A suitable pressure medium is compressed air.

As a result of the applied pressure, the pneumatic cylinder 8 pivots the pivot frame 5 out of the starting position shown in FIG. 1 and upwardly in the direction of the arrow B about the axis of the joint 6. By relieving or venting the cylinder chamber 10, the pivot frame 5 moves back under its own weight into the horizontal or substantially horizontal starting position thereof, as shown in FIG. 1.

Each of the fixed and movable roller registers 3, 4 comprises corresponding sets of first and second rollers 11, 12. Each roller from the first and second rollers 11, 12 is mounted at both ends and freely rotates on bearing elements. The first and second rollers 11, 12 are oriented with their axes parallel to one another and parallel to the axis of the joint 6. The first rollers 11, which are associated with the fixed roller register 3, and the second rollers 12, which are associated with the movable roller register 4, are spaced apart from one another.

The first and second rollers 11, 12 are arranged on the fixed and movable roller registers 3, 4, or on the bearing elements 13 thereof such, that in the starting position of the pivot frame 5, in the longitudinal direction of the flat material 2, a second roller 12 alternates with a first roller 11 in each case and the rollers 12 of the movable roller register 4 are situated at a level beneath the rollers 11 of the fixed roller register 3. This arrangement of the first and second rollers 11, 12 in the lower position or starting position of the pivot frame 5 enables particularly easy threading of the flat web material through the buffer store 1. The first and second rollers 11, 12 are each adapted to the width of the flat web material 2 in the manner of a drum.

The bearing elements for the rollers 12 of the movable roller register 4 or for the axes of these rollers are formed, in the embodiment shown, by extensions 5.2.1 of two arms 5.2 that accommodate the second rollers 12 therebetween and that are offset relative to one another in an axis direction toward the drawing plane of FIG. 1. The two arms 5.2 form part of the pivot frame 5 comprising the movable roller register 4.

During normal operation, the operating pressure in the cylinder chamber 10 of the pneumatic cylinder 8 is on the order of 2-3 bar. As a result, the pivot frame 5 is pivoted out of the starting position thereof and the flat web material is guided under tension between the fixed and movable roller registers 3, 4. The pneumatic cylinder 8 therefore acts as a gas spring that pre-tensions the pivot frame 5 in the direction of the arrow B. The length of flat material 2 stored in the buffer store 1 can be altered by pivoting the pivot frame 5 by means of the gas spring or against the action of the gas spring.

During normal operation, a protective device 15 protects the buffer store 1 and, in particular, the pivot frame 5 and the movement space thereof, against access. The protective device 15 is locked before the buffer store 1 is put into operation. In particular, the protective device 15 is locked before the operating pressure is applied to the cylinder chamber 10. A suitable protective device includes a pneumatic locking device.

In the case of a machine standstill, for example, when the system is switched off for processing the flat material 2, or in the event of a fault, particularly a fault arising from tearing of the flat web material 2, or when the material is changed, the pressure medium is trapped in the cylinder chamber 10. The pressure of the pressure medium in the cylinder chamber 10 is then reduced to a residual pressure that lies significantly below the operating pressure, but that is still sufficient to hold the pivot frame 5 against the weight thereof in a pivot position that corresponds to the pivot position of the pivot frame 5 before the machine standstill or the fault. In this state, the flat material that is guided through the fixed and the movable roller registers 3, 4 remain, to some extent, under tension. In particular, the flat material is still under enough tension so that the flat material continues to run flat or substantially flat between the first and second rollers 11, 12.

This control of the buffer store 1 and of the pneumatic cylinder 8 leads to a substantial improvement in operating safety and ease of use of the buffer store 1. Trapping of the pressure medium in the cylinder chamber 10 and reducing the pressure therein in the event of a machine standstill or a fault to the much lower residual pressure initially prevents the pivot frame 5 from jerking upward. This reduces the risk of serious injury should the flat web material tear or be removed.

Another advantage of the arrangement is that the residual pressure in the cylinder chamber 10 holds the pivot frame 5 and the movable roller-register 4 in a pivot position so that, in this position, the course of the flat material 2 through the fixed and movable roller-registers 3, 4 can be checked.

The residual pressure is preferably adjusted so that, on tearing of the flat material and the subsequent relieving of the pivot frame 5 and expansion of the cylinder chamber 10, the residual pressure is further reduced, for example, to a value of 0.5 bar. The pivot position that is then assumed by the pivot frame 5 due to the weight thereof differs only slightly from the pivot position that the pivot frame 5 had assumed before the tearing of the flat web material 2. This effectively prevents the pivot frame 5 from jerking upward.

The residual pressure also prevents unwanted automatic pivoting of the pivot frame 5 into the lower starting position thereof. The course followed by the flat material within the buffer store 1 before the machine standstill or the fault is maintained.

If the reduction of the pressure in the cylinder chamber 10 is carried out by venting via a relief valve or safety valve that opens at a pressure above the residual pressure that is striven for and that blocks at the residual pressure and at a pressure below the residual pressure, then it is still possible to manually press the pivot frame 5 downward in the direction of the lower starting position thereof. This is useful, for example, for threading the flat material 2.

A control device 16 provides control over the pneumatic cylinder 8. The control device 16 comprises, in series in a line or connection connecting the cylinder chamber 10 to a source for the pressure medium: a pressure controller 17, a first multi-way control valve 18, a second multi-way control valve 19, a throttle 20, and a non-return valve 21. The pressure controller 17 is preferably adjustable. The non-return valve 21, which is arranged parallel to the throttle 20, guides the flow by opening for flow out of the cylinder chamber 10 and blocking flow in the opposing direction.

In normal operation, the pneumatic cylinder 8 places the flat material 2 between the fixed and movable roller registers 3, 4 under tension. Under these circumstances, the first and second multi-way control valves 18, 19 are switched so that they cooperate with the throttle 20 to apply the constant operating pressure that exists at the output of the pressure controller 17 to the cylinder chamber 10.

With the protective device 15 closed, the possibility also exists, through suitable control of the control valve 18 to vent the cylinder chamber 10 via the non-return valve 21, the control valve 19 and a venting line 22 opened via the control valve 18 or to vent the cylinder chamber 10 via a throttle/non-return valve combination 23 and a venting filter 24 provided in the venting line, to pivot the pivot frame 5 into the lower starting position. This can be useful to guide or thread in a new web of the flat material 2, to relieve the web of flat material 2 entirely in the region of the buffer store 1, or to remove the buffer store 1 from the system.

In the event of a machine standstill or a fault or before opening the protective device 15, the control valve 19 is switched so that the valve separates the connection to the control valve 18 and essentially connects the cylinder chamber 10 via the non-return valve 21 to a relief valve or safety valve 25. This relieves or vents the cylinder chamber 10 to the residual pressure to which the safety valve 25 is set, for example, to a residual pressure of approximately 1 bar.

To maintain the residual pressure in the cylinder chamber 10 in the event of a fault in the source supplying the pressure medium or in the pressure medium feed, the control valve 19 can be actuated, for example, pneumatically.

The invention has been described above using exemplary embodiments. It should be understood that numerous alterations and variations are possible without departing from the fundamental inventive concept on which the invention is based.

The invention claimed is:

1. An apparatus comprising a buffer store for guiding flat web material, said buffer store comprising a first roller register, a second roller register, a pivot arm, a first set of rollers on said first roller register, a second set of rollers on said second roller register, a piston/cylinder arrangement, a control device, and a relief valve, wherein said rollers in said first set of rollers are freely rotatable, wherein said rollers in said second set of rollers are freely rotatable, wherein said first set of rollers comprises a first roller that rotates about a roller axis, wherein said roller axis defines a radial direction that is perpendicular to said roller axis, wherein said first roller register is moveable relative to said second roller register along said radial direction, wherein said first roller register and said second roller register are structurally configured to cooperate in forming loops of said flat web material between rollers of said first set of rollers and rollers of said second sets of rollers, wherein said loops have lengths that vary in response to movement of at least one of said first and second roller registers, wherein said pivot arm supports one of said first roller register and said second roller register, wherein said pivot arm is characterized by a mass, wherein said piston-cylinder arrangement comprises a cylinder chamber, wherein, in operation, said cylinder chamber contains a compressible pressure medium, wherein, as a result of said compressible pressure medium in said cylinder chamber, said piston-cylinder chamber is structurally configured to operate as a spring between said first roller register and said second roller register, wherein, in operation, said piston-cylinder chamber causes web tension in said flat web material as said flat web material is guided through said buffer store, wherein said control device comprises a first control valve arrangement, wherein said first control valve arrangement is configured to switch between operating in a first condition and operating in a second condition, wherein said control device is configured to cause said first control valve arrangement to switch into operating in said first condition during normal operation of said buffer store, wherein said control device is configured to cause said first control valve arrangement to switch into operating in said second condition during abnormal operation, wherein said abnormal operation is selected from the group consisting of a operation during a machine standstill and operation during a machine fault, wherein, when said first control valve arrangement is operating in said first condition, said first control valve arrangement connects said cylinder chamber of said piston-cylinder arrangement to a pressure source for providing a normal operating pressure, wherein, when said first control valve arrangement is operating in said second condition, into which said first control valve arrangement is switched in the event of one of a machine standstill and a fault, said first control valve arrangement traps pressure medium in said cylinder chamber, thereby causing said cylinder chamber to assume a selected abnormal operating pressure, wherein said selected abnormal operating pressure is a function of said mass of said pivot arm, wherein said selected abnormal operating pressure is above atmospheric pressure, and wherein said selected abnormal operating pressure is below said normal operating pressure, and wherein, to transition into said second condition, said first control valve arrangement connects said cylinder chamber to said relief valve, thereby causing pressure in said cylinder chamber to decrease from said normal operating pressure to said abnormal operating pressure, wherein said first control valve arrangement is configured such that when pressure from said pressure medium at said first control valve arrangement falls below a threshold, said first control valve arrangement assumes said second condition thereof in response.

2. The apparatus of claim 1, wherein said relief valve comprises a safety valve that opens at a pressure above said abnormal operating pressure and blocks at a pressure that is equal to or smaller than the residual pressure.

3. The apparatus of claim 1, wherein said abnormal operating pressure is set to approximately 30% to 40% of said normal operating pressure.

4. The apparatus of claim 1, further comprising a throttle with a non-return valve arranged parallel to said throttle, wherein said throttle provides a connection between said first control valve arrangement and said piston-cylinder arrangement, wherein said non-return valve is configured to open for flow out of said cylinder chamber and to block flow in a direction that opposes said flow out of said cylinder chamber.

5. The apparatus of claim 4, wherein said throttle comprises an adjustable throttle.

6. The apparatus of claim 1, further comprising a pressure controller for providing said operating pressure.

7. The apparatus of claim 1, further comprising a second control valve arrangement, wherein said second control valve arrangement is controllable between a first condition and a second condition, wherein, when said second control valve arrangement is in said first condition and said first control valve arrangement is in said first condition thereof, said second control valve arrangement connects said cylinder chamber of said piston-cylinder arrangement to said pressure source for providing a normal operating pressure, and wherein, in said second condition, said second control valve arrangement vents said cylinder chamber into the atmosphere.

8. The apparatus of claim 1, wherein at least one of said first and second roller registers is a fixed roller register and at least one of said first and second roller registers is a movable roller register.

9. The apparatus of claim 1, further comprising a machine frame, wherein one of said first and second roller registers comprises a movable roller provided on said pivot arm, and wherein said piston-cylinder arrangement acts between said pivot arm and said machine frame.

10. The apparatus of claim 1, wherein said piston-cylinder arrangement is configured to act as a gas spring.

11. The apparatus of claim 1, wherein said piston-cylinder arrangement is configured to act as a compression spring.

* * * * *